United States Patent [19]

Goddard et al.

[11] 4,135,956

[45] Jan. 23, 1979

[54] COPRECIPITATED PYROTECHNIC COMPOSITION PROCESSES AND RESULTANT PRODUCTS

[75] Inventors: Terrence P. Goddard, Aptos; Donald N. Thatcher, Hollister, both of Calif.

[73] Assignee: Teledyne McCormick Selph, Hollister, Calif.

[21] Appl. No.: 694,626

[22] Filed: Jun. 10, 1976

Related U.S. Application Data

[63] Continuation-in-part of Ser. No. 585,216, Jun. 6, 1975, abandoned.

[51] Int. Cl.[2] ..... C06B 31/00; C06B 43/00

[52] U.S. Cl. ..... 149/22; 149/108.6; 149/109.2

[58] Field of Search ..... 149/22, 108.6, 109.2

[56] References Cited

U.S. PATENT DOCUMENTS

| | | | |
|---|---|---|---|
| 3,107,613 | 10/1963 | Armstrong et al. | 149/61 X |
| 3,126,305 | 3/1964 | Armstrong | 149/61 X |
| 3,148,938 | 9/1964 | Knoth | 149/22 X |
| 3,149,163 | 9/1964 | Knoth | 149/22 X |
| 3,256,056 | 6/1966 | Armstrong | 149/22 X |
| 3,617,403 | 11/1971 | Johnson | 149/22 X |
| 3,706,608 | 12/1972 | Geisler | 149/22 X |
| 3,976,521 | 8/1976 | Boyd et al. | 149/22 X |
| 4,002,681 | 1/1977 | Goddard | 260/564 D |

*Primary Examiner*—Edward A. Miller

*Attorney, Agent, or Firm*—David H. Semmes; Warren E. Olsen

[57] ABSTRACT

This invention relates to novel pyrotechnic materials useful in pyrotechnic, incendiary, and propellant compositions, and a method of their preparation. The process is characterized by being a cocrystalization of certain salts of decahydrodecaboric acid and certain oxidizing agents, the resulting coprecipitates are compositions chemically and physically distinct from the starting materials.

26 Claims, 5 Drawing Figures

COPRECIPITATED PYROTECHNIC COMPOSITION PROCESSES AND RESULTANT PRODUCTS

CROSS-REFERENCES TO RELATED APPLICATIONS

This application is a continuation-in-part of copending application, Ser. No. 585,216, filed June 6, 1975, entitled HIGH BURN PROPELLANT COMPOSITIONS, now abandoned. Certain specific applications of the subject invention are taught in our copending applications ACTIVE BINDER PROPELLANTS INCORPORATING BURNING RATE CATALYSTS filed June 15, 1976 and HIGH BURNING RATE PROPELLANTS WITH COPRECIPITATED SALTS OF DECAHYDROCECABORIC ACID, Ser. No. 707,810, filed July 22, 1976.

BACKGROUND AND SUMMARY OF THE INVENTION

The present invention describes a family of new and unique pyrotechnic compositions and a method of preparing them. The compositions consist of selected metallic and nonmetallic salts of decahydrodecaboric acid, in combination with certain oxidizing agents. The method of preparing the compositions results in chemical substances in which there is intercrystalline mixing of the substituents, in a chemical state not obtainable by physical blending.

The unique character of the new compositions is produced by the method of manufacture. In the process, the decahydrodecaborate (−2) salt and oxidizer are dissolved in a suitable solvent. The solution containing the salt and oxidizer are pumped under pressure through a nozzle into a mixing chamber containing a high flow rate of a suitable nonsolvent. The dissolved ingredients are rapidly precipitated into very fine intertwined crystals containing the original constituents in a different physical and chemical environment than the starting crystals.

The physical, thermochemical, and kinetic properties of the new compositions are radically different than the corresponding physical blends of the starting ingredients. The pyrotechnic performance of the new compositions is wholly unpredicted by studies of the corresponding physical blends. Analysis of the infrared spectra of the subject compositions reveals that the critical ingredients, in particular the decahydrodecaborate (−2) ion, are in different chemical environments than the starting ingredients. In addition, the particles produced by the rapid precipitation are of smaller and more uniform particle size than the starting ingredients. These facts demonstrate that the decahydrodecaborate (−2) ion is in very intimate contact with the oxidizing species, which results in far more uniform and predictable burning than is obtainable by other means of combining the ingredients.

The compositions of this invention are very useful for a variety of purposes. They are excellent ignition materials for other pyrotechnic, incendiary, or propellant compositions, such as gun and rocket propellants. Confined in a metal sheath, they exhibit a range of burn rates and stability unobtainable by any other compositions. They can be incorporated as burn rate catalysts into rocket and gun propellants. A rocket or gun propellant can be made from the subject compositions by combining them with a suitable binder and other pyrotechnic ingredients and stabilizers; the propellants made by this method exhibit a fast burn rate wholly unobtainable by using physical blends of oxidizers and fuels in a similar binder.

The most significant property of the final compositions is that, despite a very high energy content, they do not detonate when confined, but burn at a steady and predictable rate.

DETAILED DESCRIPTION OF THE INVENTION

Figure 1:
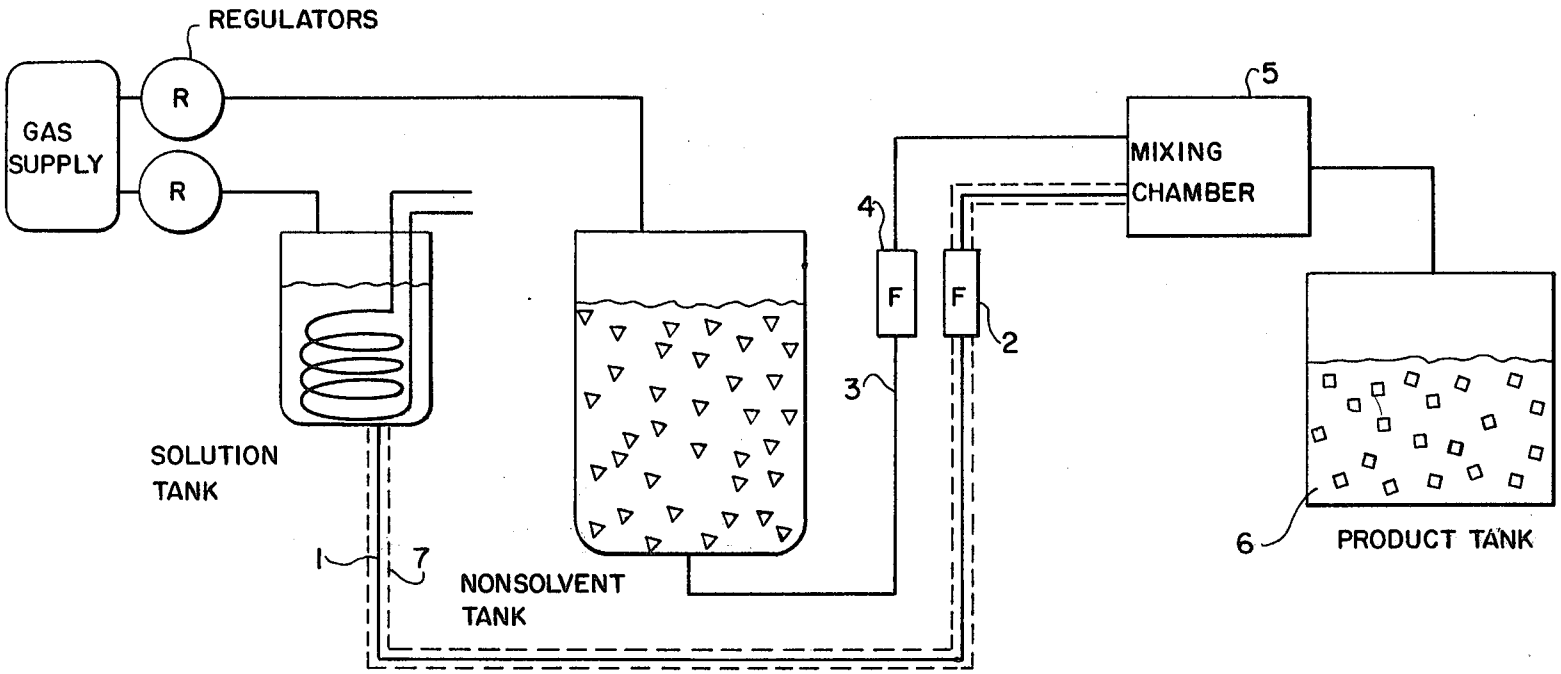
FIG. 1 is a schematic representation of a coprecipitation sequence according to the present invention.

The simple decahydrodecaborate salts used as a starting material according to this invention are compounds of the general chemical formula:

$$M_x(B_{10}H_{10})_y$$

where M is a cation or complex cation incorporating hydrogen, nitrogen, carbon, or metals, or some combination thereof, and is chosen from the list given below; x is the number of M ions; and y is equal to:

$$\frac{x \text{ times the valence of the } M \text{ ion}}{2}$$

The compounds may further be defined as salts of decahydrodecaboric acid, and thus contain as a common ion the decahydrodecaborate (−2) anion $B_{10}H_{10}^{-2}$.

The cation M is chosen from the classes:

a. ammonium, $NH_4+$, wherein the salt has the formula $(NH_4)_2\,B_{10}H_{10}$, and is described by KNOTH U.S. Pat. No. 3,148,938.

b. hydrazinium, $NH_2NH_3^+$, wherein the salt has the formula $(NH_2NH_3)_2B_{10}H_{10}$, and is described by KNOTH U.S. Pat. No. 3,148,938, c. substituted ammonium cations, wherein the salt has the general formula $(R_3NH)_2B_{10}H_{10}$, where R can be hydrogen (H) or an alkyl radical (preferred radicals contain less than six (6) carbon atoms). The R's in the preceding formula may represent different alkyl groups. Compounds with two or three hydrogen radicals are described by KNOTH U.S. Pat. No. 3,149,163. Typical cations are methylammonium $(CH_3)NH_3^+$, dimethylammonium $(CH_3)_2NH_2^+$, trimethylammonium $(CH_3)_3NH^+$, and triethylammonium $(CH_3CH_2)_3\,NH^+$.

d. substituted hydrazinium cations, wherein the salt has the general formula $(R_2NNR_2H)_2B_{10}H_{10}$, where R can be hydrogen (H) or an alkyl radical (preferred radicals contain less than six (6) carbon atoms), and the substituted alkyl groups can be symmetric or assymmetric with respect to the N-N linkage. Symmetric substitutued cations are described by KNOTH U.S. Pat. No. 3,149,163. An example of an unsymmetric substituted cation is (1,1) dimethylhydrazinium. The R's in the preceding formula may be mixed alkyl radicals.

e. quaternary ammonium salts of the general formula $(R_4N)_2B_{10}H_{10}$, where R is an alkyl radical; the R, s in the preceding formula may represent mixed alkyl groups. Examples of typical cations are tetramethylammonium $(CH_3)_4N^+$ and tetraethylammonium $(CH_3CH_2)_4N^+$.

f. aryl containing cations, such as pyrididinium, bipyridinium, or substituted aryl cations, such as aryl-diazonium cations.

g. guanidinium ion, $C(NH_2)_3^+$, wherein the salt has the formula $(C(NH_2)_3)_2B_{10}H_{10}$, and is described in the copending application of common assignment, entitled BIS-GUANIDINIUM DECAHYDRODECABORATE AND A PROCESS FOR ITS PREPARATION, filed June 10, 1976, and now U.S. Pat. No. 4,002,681.

h. metal ions, derived from metals defined by a Periodic Table such as that in the "Handbook of Chemistry and Physics", 54th Edition, inside front cover, by the elements in Groups 1, 2, 8, 3b, 4b, 5b 6b and 7b, and the elements of Groups 3a, 4a, 5a, and 6a with atomic numbers greater than 5, 14, 33, and 52 respectively. The metal decahydrodecaborate salts are further described by KNOTH U.S. Pat. No. 3,148,939. Examples of such metal salts are $Cs_2B_{10}H_{10}$ and $K_2B_{10}H_{10}$, the cesium and potassium salts of decahydrodecaboric acid. The cesium salt is a particularly preferred metal decahydrodecaborate salt for the compositions described in this invention.

The salts of the decahydrodecaborate (−2) ion (Chemical formula $B_{10}H_{10}^{-2}$) are conveniently prepared by stoichiometrically reacting an aqueous solution of the parent acid, dihydrogen decahydrodecaborate, $H_2B_{10}H_{10}$, with (1) a soluble hydroxide of the desired cation, such as ammonium hydroxide, (2) the conjugate Brønsted base of the desired cation, such as a free amine, or (3) a soluble salt of the desired cation, such that the salt anion is destroyed during the reaction, such as guanidine carbonate. A Brønsted base is any substance capable of accepting a proton in a reaction; the definition is elaborated upon in any elementary chemistry text, such as Dickerson, Gray and Haight, "Chemical Principles, 2nd Edition," 1974, page 135.

The aqueous solutions of the salts, prepared above, may be evaporated to dryness to recover the crystalline salt. Alternatively, some salts may be precipitated from the aqueous solution by a nonsolvent that is miscible with water. The salts may be purified by recrystallization.

The aqueous decahydrodecaboric acid used as a starting material for the process of this invention is conveniently prepared by passing an amine or metal salt of the decahydrodecaborate (−2) ion through a column containing a strongly acidic ion exchange resin of the sulfonic acid type, such as a DUOLITE type "C-20", acid form by the Diamond Shamrock Corporation. Preferred starting salts are bis(triethylammonium) decahydrodecaborate (−2) and disodium decahydrodecaborate (−2). The preparation and properties of the aqueous acid, and additional preparative methods for metallic salts, are described in more detail in U.S. Pat. No. 3,148,939.

The second essential component of the subject pyrotechnic compositions is an oxidizing agent, i.e., a material that will readily react or burn when mixed with the decahydrodecaborate (−2) salt. Any solid oxidizing agent which will yield oxygen upon decomposition will fulfill this role; solid oxygen containing metal or nonmetal salts are preferred because of their availability, stability, and ease of incorporation into the composition.

Solid oxidizing agents useful in this invention must meet certain criteria, such as listed in the description of the coprecipitation process. In general, solid oxidizing agents include ammonium, substituted ammonium, guanidine, substituted guanidine, alkali and alkaline-earth salts of oxygen containing acids such as nitric, perchloric, permanganic, manganic, chromic, and dichromic acids. Preferred species for this invention, which gave good thermal stability and low hygroscopicity include ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate. Other solid oxidizing agents which could be used if the appropriate solvent/nonsolvent system were used include ammonium, substituted ammonium, guanidine, substituted guanidine, alkali and alkaline-earth salts of other oxygen-containing acids such as chloric, persulfuric, thiosulfuric, periodic, iodic and bromic acids. Other stable oxidizers include lead thiocyanate, the oxides and peroxides of the light and heavy metals and nonmetals, such as barium peroxide, lead peroxide ($PbO_2$), lithium peroxide, ferric oxide, red lead ($Pb_3O_4$), cupric oxide, tellurium dioxide, antimonic oxide, etc. and nonionic substances such as nitrocellulose, nitroguanidine, and cyclotetramethylenetetranitramine (HMX). Mixtures of the aforementioned oxidizing agents also can be used.

The compositions of this invention make use of the unique decomposition properties of the decahydrodecaborate (−2) ion, a bicapped square antiprism polyhedral ion with unusual stability; the ion is believed to be kinetically rather than thermodynamically stabilized. The ion demonstrates an unusually fast decomposition upon oxidation, which is believed to proceed through the labile apical hydrogen atoms bonded to the cage. Pyrotechnic compositions based on a physical blend of the metallic salts of this ion with various inorganic oxidizers have been recognized by ARMSTRONG, U.S. Pat. No. 3,126,305 as providing a wide range of confined burning rates. Physical blends of non-metallic salts of the decahydrodecaborate ion which produce extremely fast deflagration rates and high heat and gas outputs are described in our copending application entitled IGNITION AND PYROTECHNIC COMPOSITIONS, filed June 10, 1976, as Ser. No. 694,625.

The compositions of this invention, as well as those taught in our above-noted copending application, are unique in that, despite the fact that a high energy fuel, namely those decahydrodecaborate (−2) salts represented by the cation classes (a) through (g) is being used, the reaction does not propagate to a detonation, as is true with most commonly used high energy compositions such as commercial and military explosives. This unusual property is due to the fact that the reaction mechanism is kinetically rather than thermodynamically controlled, i.e., the deflagration occurs in such a manner that much heat is generated in the reaction without this heat accelerating the reaction to the point of detonation. The distinction between deflagration and detonation is used in the common sense, whereby in deflagration, the chemical change or "burning" of the fuel occurs in advance of compression front caused by the expanding gases whereas in detonation the chemical reaction occurs after the compression or shock wave propagates through the composition medium. A more detailed explanation of this phenomenon may be found in a text on explosives such as C. H. Johansson and P. A. Persson "Detonics of High Explosives", (Academic Press, N.Y., 1970).

A critical factor in obtaining reproduceable and uniform buring a composition containing the decahydrodecaborate (−2) is recognized by those practiced in the art to be an intimate contact between the decahydrodecaborate (−2) ion and the specific ion or oxidizing species which effects the initial oxidative step which leads to the breakup of the borane ion. This intimate contact is attempted in common practice by physically blending very finely ground or prepared powders of the decahydrodecaborate (−2) salt with the oxidizing agent.

The physical blends of oxidizer with the decahydrodecaboric acid salts, as described in our copending application noted above, suffer from several deficiencies inherent in the physical blend properties and processing technique. When used as a confined column delay, in a lead sheath, for example, the burn rates may be unreproduceable, and the column fails to propagate below a certain critical distribution of the mixture in the tube. The stoichiometry of a physical blend is always subject to point-to-point variations due to blending techniques, settling and separation of the separate ingredients, and particle size distributions of the constituent materials.

A method is thereby needed to produce a composition with very uniform composition, in which the fuel anion and oxidizer are in very intimate contact, and which is very reproduceable in manufacturing techniques from lot to lot. It has been discovered that such an intimate mixture can be obtained if the decahydrodecaborate (−2) anion is mixed in the crystal lattice with the oxidizing agent, such as a nitrate ion, and if crystals containing the respective ions and oxidizing agents are intimately intertwined.

The process by which the compositions of this invention are prepared produces a very intimate blend of decahydrodecabotate (−2) ion with the oxidizer, and makes the compositions so prepared chemically and physically unique from physical blends of decahydrodecaborate (−2) salts with oxidizer or pyrotechnic compositions incorporating decahydrodecaborate (−2) salts produced by other means. In general, the process consists of dissolving, in a suitable solvent, a decahydrodecaborate (−2) salt, as described above, and also dissolving, in the same solution, an oxidizing agent, as described above. The subject composition is recovered by precipitating the composite ingredients of the solution with a suitable nonsolvent. The resulting solid, after filtration and drying, comprises an intimate mixture of the decahydrodecaborate (−2) anion with the oxidizing cation or substance, in a form that is chemically and physically different than the starting materials.

The process may be properly called a "cocrystallization" or "coprecipitation" and the resulting product a "cocrystallate" or "coprecipitate".

In order to successfully coprecipitate the decahydrodecaborate (−2) salt with the oxidizing agent, three criteria on the composite system must be met:

a. Both the decahydrodecaborate (−2) salt and the oxidizing agent must be soluble in the same solvent.
b. The resulting coprecipitate must be insoluble in the solvent/nonsolvent fluid resulting from the mixing process.
c. Solvent and nonsolvent must be miscible in all proportions.

Examples of solvent/nonsolvent systems which meet the last criteria, and, depending on the individual ingredients' solubility, can be used to produce certain of the subject compositions, include water/acetone, water/isopropyl alcohol, methanol/toluene and methanol/butyl acetate. Other solvents and/or nonsolvents include but are not limited to ethanol, t-butyl alcohol, ethylene glycol, ethylene glycol butyl ether, diacetone alcohol, methylisobutyl ketone, diisobutylketone, methyl ethyl ketone, dimethylformamide, tetrahydrofuran, glycerol, xylenes, dimethylsulfoxide, and n-methyl pyrrolidinone.

A general requirement for the preparative process is that the mixing between solution and nonsolvent be rapid, in order that the precipitating ingredients may be intimately mixed. A slow crystal growth in which the various anions and cations or constituents in the crystal lattice are well ordered is avoided in the rapid precipitation process. A mixing generally known in the chemical processing industry as "rapid mixing" or "static mixing" can be specially adapted to produce the desired compositions.

A general schematic diagram of an apparatus suitable for producing a sufficiently rapid and complete precipitation of the composition ingredients is shown in FIG. 1. The essential subsystems include 1, a storage tank and plumbing to deliver a specified flow rate of solution into a mixing chamber; 2, a means to carefully control the forementioned flow rate; 3, a storage tank and plumbing to deliver the nonsolvent to the mixing chamber; 4, a means of controlling the nonsolvent flow rate; 5, a mixing chamber with fluid dynamic behavior suitable for achieving the required mixing conditions; 6, a means of collecting the effluent containing the coprecipitated composition; 7, a means of maintaining an adequate temperature in the solution flow path. In operation, the solution of the desired decahydrodecaborate (−2) salt and oxidizer is placed in the "solvent" tank, which may be heated by internal coils or an external steam or water jacket. The solution is pumped to the mixing chamber by pressurizing the storage tank; the line through which the solution flows may be heated by a steam or water jacket or heating tapes. The flow rate may be regulated by introducing into the solution line a flowmeter with an adequate flow adjustment, or alternately, by controlling the driving pressure in the tank such that the pressure in the tank such that the pressure in conjunction with the nozzle aperture resistance results in the desired flow. The nonsolvent is placed in a storage tank of adequate capacity, and likewise pumped under pressure into the mixing chamber.

The mixing chamber design and resulting dynamics of fluid mixing in the chamber is critical to the successful coprecipitation of the subject composition. It is essential in the precipitation process that the solvent and nonsolvent be brought together very rapidly and under conditions of extreme turbulence, in order to produce the requisite intermingling of the solution and nonsolvent which effects the actual precipitation. Two designs which successfully accomplish this rapid precipitation are shown in FIGS. 2 and 3.

Figure 2:
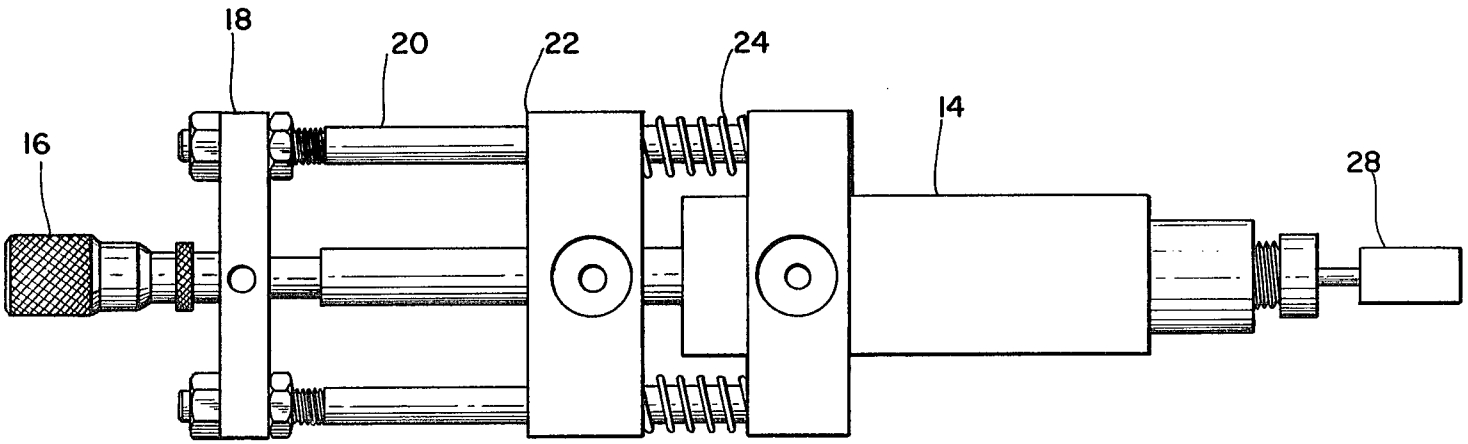
FIGS. 2 and 3 are schematic representations of a first form of coprecipitation apparatus usable according to the present invention.
Figure 3:
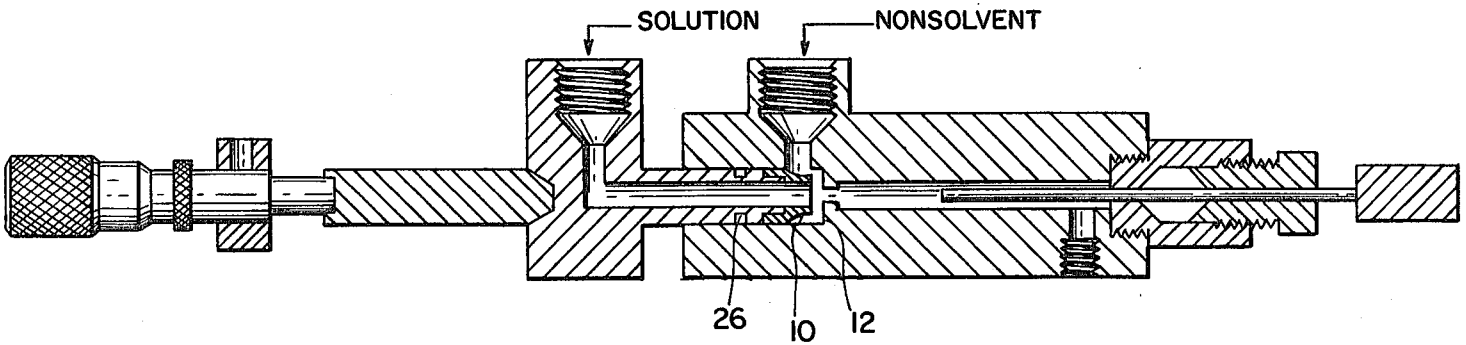

FIGS. 2 and 3 show an apparatus suitable for producing the subject compositions on a 50 to 500 gram laboratory scale. The solution is pumped through a moveable nozzle 10 consisting of an array of small apertures into the mixing chamber 12. The nozzle aperture and pattern are designed to optimize flow rates and turbulence for a fluid of particular viscosity; aperture diameters between 0.005 and 0.025 inches and equally spaced on a circle between 0.020 and 0.075 inch diameter are preferred. A useful configuration consists of 8 0.010 inch diameter holes equally spaced on a 0.060 diameter circle. The mixing chamber volume is controlled by movement of the nozzle in block 14. The nozzle is moved by micrometer 16 mounted in block 18 sliding on rails 20; block 22 is held against the micrometer by springs 24. A sliding seal 26 prevents leakage from the mixing chamber. Thermocouple 28 monitors the effluent temperature. Distance or "gap" between the nozzle tip and chamber wall may be varied between 0 and 0.300 inches in order to provide a variable back pressure on the nonsolvent flow. The range 0.015 and 0.050 inches is preferred for optimum mixing when a fluid with a viscosity similar to water is the non-solvent. The nonsolvent is pumped directly into the mixing chamber, as shown. The edge of the nozzle assembly 10 creates the necessary turbulence for effective mixing. The coprecipitate is carried by the effluent stream out to an outflow port, and thence to a catch tank. As shown in FIG. 1, flows are controlled by flowmeters in the input lines. Flows on the solvent line may be varied between 30 and 600 cubic centimeters per minute for a fluid with viscosity similar to water. Tank capacities are 2 liters solution and 20 liters nonsolvent. Filtration and drying of the precipitate in the catch tank recovers the desired product.

Figure 4:
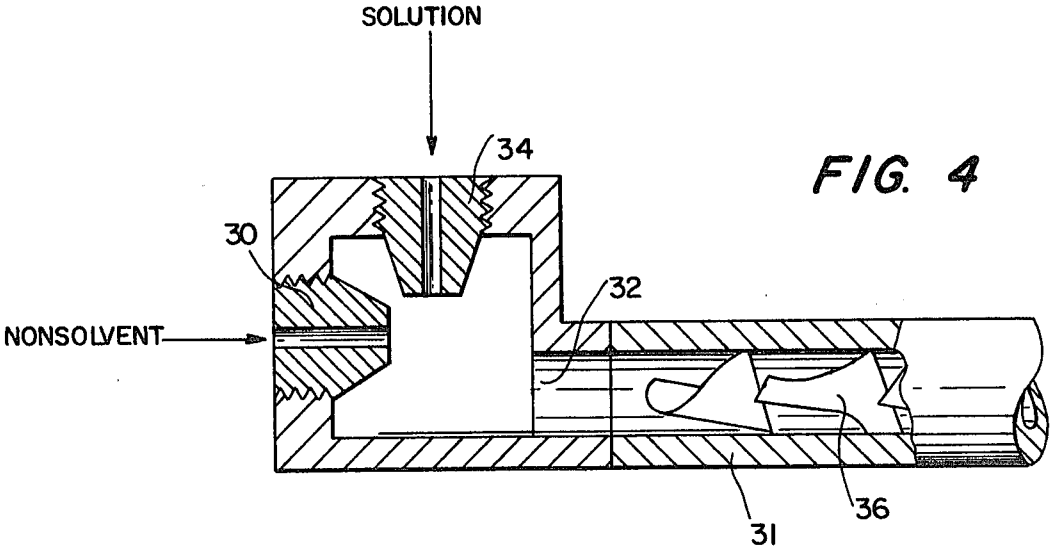
FIG. 4 is a schematic representation of a second form of coprecipitation apparatus usable according to the present invention.

FIG. 4 shows a second mixer for FIG. 1, suitable for producing larger quantities of the subject compositions. The solution is pumped through nozzle 30 into mixing chamber 32, of internal dimensions on the order of 2 inches. The nonsolvent flows through nozzle 34 into the same chamber at right angles to nozzle 30. The nozzles may be standard spray nozzles such as those purchased from the Spray Engineering Company, Burlington, Mass. The coprecipitated effluent from the mixing chamber flows through a tube 34 containing curved sheet like elements 36 within the tube; the tube mixing device itself is known and described for example in ARMENIADES, U.S. Pat. No. 3,286,992. In this apparatus the majority of coprecipitation occurs at the intersection of the spray nozzles. The tube element 36 is merely an auxiliary mixer that assures complete and rapid precipitation of any product not precipitated in the main chamber. Flow rates on this apparatus are controlled by the driving pressure behind the nozzles, which generates the required constricture in the flow. The range of preferred driving pressure is 10 to 150 pounds per square inch guage, for each of the process streams.

While crystalline size may be affected by choosing the Apparatus of FIGS. 2 or 4, for the purposes of this invention this is irrelevant. Regardless of coprecipitated particle size, the chemical natures of these coprecipitates are indistinguishable, as evidenced by pyrotechnic performance tests.

The concentrations of decahydrodecaborate (−2) salt and oxidizer in the starting solution, the operating temperature of the solution flowing in the apparatus, and the ratio of flow rates of solution to nonsolvent must be chosen individually for each decahydrodecaborate (−2) salt and oxidizer combination desired. Practically speaking, the solution concentrations are preferred to be within a factor of 5 of the saturation concentrations at the operating temperature used, in order to minimize nonsolvent usage and therefore cost. Sparingly soluble oxidizers or decahydrodecaborate (−2) salts may be dissolved at elevated temperature; the elevated temperature must be maintained in the coprecipitator storage tanks and flow lines in order to prevent a drop in the fluid temperature with accompanying premature precipitation of the constituents before reaching the mixing chamber. The solution/nonsolvent flow ratio must be sufficiently small to assure complete precipitation of the desired product. Alternately, the initial concentrations of the salt and oxidizer in the solution may be adjusted so that the desired stoichiometric product is obtained for a fixed solution/nonsolvent ratio.

The subject compositions are recovered by filtering and washing the precipitate. A washing with an inert and nonsolvent fluid after filtration is an essential step in recovering a useful product. A preferred washing fluid is butyl acetate. The washing is necessary to give a product that can be readily broken up into a fluffy powder after the drying process. A preferred drying process consists of allowing the washed powder to dry for 18 to 30 hours in open air, followed by subsequent forced air oven drying for 48 hours minimum at 60 to 80 degrees Centigrade.

The products recovered from the filtration and washing, after drying, are very fine, fluffy powders with a relatively low bulk density, indicating that the effective particle size of the material is very small. Viewed under a microscope, the powders consist of agglomerates of very small intertwined crystals.

The crystal density of the compositions, as measured by tightly compressing a sample of the powders, differs markedly from what is calculated for the crystal density by summing the contributions from the starting crystals. The deviations have been found to be as much as 30%, and may be either higher or lower than the calculated density. These types of data normally indicate that the crystal compositions and structure are different than a physical blend of the starting ingredients.

Significantly, the IR spectra of the subject compositions are found to differ substantially from a superposition of the spectra of the starting materials. A particularly useful spectral feature for analysis of the chemical species is the boron-hydrogen stretching frequency in the vicinity of 2500 $cm^{-1}$; this feature is a characteristic of the decahydrodecaborate (−2) ion, and substructure on the region can be used to compare chemical and crystal environments of different compositions containing the ion. It is recognized by those practiced in the art, and as further explained by Kazuo Nakamoto in "Infrared Spectra of Inorganic and Coordination Compounds", 2nd Edition, p. 61, that inorganic crystal spectra in the high frequency region, which includes the 2500 $cm^{-1}$ region, consists of combination bands of crystal lattice mode frequencies with fundamental mode characteristic frequencies. In addition, peak splittings are often caused by the occupration of more than one unique crystal lattice site by an ion, or by destruction of degeneracies in the gas phase molecular frequency by crystal lattice effects. The differences in substructure in a fundamental peak such as that of the 2500 $cm^{-1}$ band characteristic of the $B_{10}H_{10}^{-2}$ ion can thus be attributed to changes in the chemical and crystal environment of the ion.

The IR spectra of the subject compositions in the 2500 $cm^{-1}$ region show in general, and as shown in detail by the various examples to follow, that the chemical and crystal environment of the decahydrodecaborate (−2) ion is different than the starting environment, which demonstrates further that the subject coprecipitated compositions are differentiated chemically, as well as physically from their physical blend counterparts.

The pyrotechnic performance of the presently taught coprecipitated compositions is also markedly different from that of the counterpart physical blends. In general, the heat of reaction obtained by combusting the mixture in an adiabatic calorimeter under an inert gas such as argon is different from that obtained by preparing and similarly testing a simple physical blend with the exact same stoichiometry. The heat of reaction may be greater than, or less than, that displayed by the physical blend. Such behavior is in general indicative of a different burning mechanism for the subject composition than for a simple blend, which is, in part, caused by different arrangement of the chemical species.

The above general features of the subject compositions demonstrate that the chemical species initially present in the separated decahydrodecaborate (−2) salt and oxidizer before dissolution have recombined in the presently taught coprecipitation process to yield products in which the constituents originally present are arranged differently in the final crystal environment. Furthermore, and as is illustrated more particularly in Example I, the decahydrodecaborate (−2) anion, which is the critical ingredient for the unique performance of the compositions, is mixed in the crystal lattice is close proximity to the oxidizing anion, which effectively promotes an extremely efficient and uniform oxidation, and therefore improved pyrotechnic performance.

EXAMPLE I

One hundred thirty-five grams of purified cesium decahydrodecaborate (−2) ($Cs_2B_{10}H_{10}$) and 405 grams potassium nitrate are dissolved in 1260 milliliters deionized water at 60° Centigrade. The solution is filtered hot to remove a trace of insoluble residue. The solution is placed into a precipitating system shown in FIG. 1 and pumped to a mixing apparatus, as depicted in FIG. 2. Acetone is used as a nonsolvent. The product is precipitated over a period of several minutes using a solution flow rate of 90 cubic centimeters per minute, a nonsolvent flow rate of 1800 cubic centimeters per minute and a mixing chamber gap of 0.030 inches. A 50° Centigrade temperature is maintained in the solution tank and flow lines during the process. 4000 ml effluent and precipitate are collected.

The resulting product is filtered, washed with butyl acetate in the filter, and dried, first 24 hours in open air and finally 48 hours at 60° Centigrade. 59 grams of pure white precipitate is recovered.

The heat of reaction of the coprecipitated composition is 690 calories per gram. The measured crystal density is 2.25 grams per cubic centimeter. By contrast, the heat of reaction of a corresponding physical blend is measured at 825 calories per gram, and the calculated crystal density is 2.16 grams per cubic centimeter. This demonstrates that for the same apparent stoichiometry significantly altered pyrotechnic characterics are experienced.

The precipitation is repeated with the remaining solution at (a) 20:1 nonsolvent/solution ratios and mixing chamber gaps of 0.015 and 0.045 inches; at (b) 10:1 nonsolvent/solution volume ratio and 0.030 and 0.145 inch gaps; and (c) 5:1 nonsolvent/solution ratio at a 0.030 gap (FIG. 2). The precipitates are recovered as in the previous example. The measured heat of reaction for the additional coprecipitated samples are within 1.5% of the original value, and the crystal densities are within 2% of the original value. The latter test indicates that the composition has precipitated completely in the first test, and the stoichiometry of the composition is identical with that of the corresponding physical blend tested.

Infrared spectra of the precipitated materials show an altered absorption region near 2500 $cm^{-1}$. The peak in the 2500 $cm^{-1}$ region for pure cesium decahydrodecaborate (−2) shows a major peak at 2470 $cm^{-1}$ with a prominent red-shifted sideband at 2418 $cm^{-1}$ and a small blue-shifted sideband at 2540 $cm^{-1}$. The precipitated material shows a major peak at 2455 $cm^{-1}$ with two prominent blue-shifted peaks at 2520 $cm^{-1}$ and 2572 $cm^{-1}$ and a minor red shifted peak at 2410 $cm^{-1}$. The spectrum closely resembles that of a known double salt of cesium decahydrodecaborate (−2) and a cesium nitrate (reference ARMSTRONG, U.S. Pat. No. 3,107,613) which shows a major peak at 2450 $cm^{-1}$, two prominent blue-shifted peaks at 2520 and 2575 $cm^{-1}$ and a minor red-shifted peak at 2420 $cm^{-1}$. The double salt is known to have the nitrate and decahydrodecaborate (−2) anions in a one-to-one ratio in the crystal lattice. This evidence demonstrates that in all probability, the precipitate obtained from the forementioned process has the nitrate and decahydrodecaborate (−2) ions mixed in the lattice, i.e., the chemical species have been rearranged chemically during the process. Needless to say, the stoichiometry of the double salt and the coprecipitations taught herein are widely dissimilar.

EXAMPLE II

Six hundred seventy-five grams cesium decahydrodecaborate (−2) and 2025 grams potassium nitrate are dissolved in 6300 milliliters deionized water at 45° Centigrade. The solution is filtered hot to remove a trace of insoluble material. The solution is placed into a precipitating system as shown in FIG. 1 and pumped to a mixing apparatus depicted in FIG. 4. The solution spray nozzle is a Sprayco ⅛ GG 1.5 (Spray Engineering Co., Burlington, Mass.). Acetone is used as a nonsolvent, and is pumped into the chamber through a Sprayco ½ GG 3030 nozzle. The flow rates are controlled by the pressures applied to the solution and nonsolvent tanks, 25 and 89 PSIG respectively. A flow ratio of 19.8 acetone-to-solution is achieved with these pressures. The product is precipitated in two increments with several minutes operating time for each increment. A temperature of 37° Centigrade is maintained in the solution tank and flow lines throughout the process.

The resulting product is filtered, washed with butyl acetone in the filter, and dried, first 25 hours in open air and finally 48 hours minimum at 50° Centigrade. 2415 grams of a white fluffy powder (yield 89%) is recovered. The product has a heat reaction of 712 calories per gram.

EXAMPLE III

The material from Example II is confined in a lead or aluminum sheath, by loading the powder into a tube and drawing or swaging the loaded and sealed tube through a series of dies until the desired distribution of material in the sheath is reached. This distribution is normally measured in grains of powder per linear foot of the sheathed cord, and is called "core load". A lead jacketed cord exhibits a linear propagation rate of 15,300 inches per second at 25 grains per foot loading, 11,600 inches per second at 12.5 grains per foot loading and 9600 inches per second at 1 grain per foot. The material will propagate reliably at core loads of 0.15 grains per foot. An aluminum jacketed cord exhibits a linear burning rate of approximately 12,000 inches per second at 6 to 12 grains per foot loading. By contrast, comparable physical blend consisting of 25% 10 micron or smaller cesium decahydrodecaborate (−2) and 200 mesh potassium nitrate in a lead sheath exhibits a burning rate of 5300 to 7900 inches per second at 19 grains per foot, 6300 inches per second at 7.3 grains per foot, and 7400 to 8600 inches per second at 2.2 grains per foot. Importantly, physically blended material does not propagate reliably below this critical level. The subject coprecipitated composition, prepared in Example II, thus displays faster and more uniform propagation than the corresponding physical blend.

EXAMPLE IV

Seventy-six grams bis-tetramethylammonium decahydrodecaborate (−2), representative of class (e) of the preceding list of cations, and 429 grams potassium nitrate are dissolved in 2500 milliliters deionized water at ambient temperature. The solution is filtered to remove a trace of residue. The solution is placed in a precipitating apparatus as shown in FIG. 1 and pumped to a mixing apparatus as depicted in FIG. 2. Isopropyl alcohol is used as nonsolvent. The product is precipitated over a period of several minutes using a solution flow rate of 115 milliliters per minute and a nonsolvent flow rate of 1180 milliliters per minute. The mixing chamber gap is 0.030 inches. The precipitate is recovered and dried in a manner identical with Example I.

Four hundred seventeen grams of a fluffy white powder is recovered (yield 83%). The powder has a heat of reaction of 1348 calories per gram. A physical blend of the starting materials with identical stoichiometry has a heat of reaction of 1220 calories per gram. The infrared spectrum of the pure starting material, bis-tetramethylammonium decahydrodecaborate (−2), shows a single broad peak at 2470 $cm^{-1}$.

By contrast, the infrared spectrum of the recovered product in the vicinity of 2500 $cm^{-1}$ shows a sharp major peak coprecipitated at 2475 $cm^{-1}$, a prominent blue-shifted peak at 2530 $cm^{-1}$, and two major red shifted peaks at 2410 and 2435 $cm^{-1}$. The additional peaks and shift indicate that the decahydrodecaborate (−2) ion is in a different crystallographic environment than in the pure salt, i.e., the constituents have been chemically rearranged during the precipitation process.

EXAMPLE V

Three hundred seventy-eight grams of bis-tetramethylammonium decahydrodecaborate (−2) and 2144 grams of potassium nitrate are dissolved in 13 liters deionized water at ambient temperature. The solution is filtered to remove a trace of insoluble residue. The solution is placed into a precipitating system as shown in FIG. 1 and pumped to a mixing apparatus as shown in FIG. 4. The solution spray nozzle is a Sprayco ⅛ GG 1.5 (Spray Engineering Co., Burlington, Mass.). Isopropanol is used as a nonsolvent, and is pumped into the chamber through a Sprayco ½ GG 3030 nozzle. The flow rates are controlled by the pressures applied to the solution and nonsolvent tanks, 25 and 26 PSIG respectively. A flow rate of 10:1 isopropanol-to-solution is achieved with these pressures. Product is precipitated in 5 runs with approximately one minute per increment required.

The resulting product is filtered, washed and dried in a manner identical with Example II. 2522 grams of white, fluffy powder is recovered (yield 86%). The product has a heat of reaction of 1339 calories per gram and a crystal density of 1.85 grams per cubic centimeter. A physical blend with identical stoichiometry has a heat of reaction of 1220 calories per gram and a calculated crystal density of 1.93 grams per cubic centimeter.

EXAMPLE VI 22.5 grams bis-guanidinium decahydrodecaborate (−2) specified at class (g) of the preceding list of cations, and 127.5 grams guanidine nitrate are dissolved in 1500 milliliters methanol at 60° Centigrade. The solution is filtered to remove a trace of residue. The solution is placed in a precipitating apparatus as shown in FIG. 1 and pumped to a mixing apparatus as depicted in FIG. 2. Butyl acetate is used as nonsolvent. The product is precipitated over a period of several minutes using a solution flow rate of 216 milliliters per minute and a nonsolvent flow rate of 1142 milliliters per minute. The mixing chamber gap is 0.030 inches. The precipitate is recovered and dried in a manner identical with Example I.

A fluffy white powder is recovered. The powder has a heat of reaction of 849 calories per gram and a crystal density of 1.48 grams per cubic centimeter. A physical blend of the starting materials with identical stoichiometry has a heat of reaction of 900 calories per gram and a calculated crystal density of 1.02 grams per cubic centimeter.

EXAMPLE VII

Thirty grams bis-dimethylammonium decahydrodecaborate (−2), representative of class (c) of the preceding list of cations, and 120 grams potassium nitrate are dissolved in 500 milliliters deionized water at ambient temperature. The solution is filtered to remove a trace of residue. The solution is placed in a precipitating apparatus as shown in FIG. 1 and pumped to a mixing apparatus as depicted in FIG. 2. Isopropanol is used as nonsolvent. The product is precipitated over a period of several minutes using a solution flow rate of 116 milliliters per minute and a nonsolvent flow rate of 1218 milliliters per minute. The mixing chamber gap is 0.030 inches. The precipitate is recovered and dried in a manner identical with Example I.

A fluffy white powder is recovered. The powder has a heat of reaction of 1411 calories per gram and a crystal density of 1.72 grams per cubic centimeter. A physical blend of the starting materials with identical stoichiometry has a heat of reaction of 1325 calories per gram and a calculated crystal density of 1.98 grams per cubic centimeter.

EXAMPLE VIII 37.5 grams bis-ammonium decahydrodecaborate (−2), representative of class (a) of the preceding list of cations, and 112.5 grams ammonium nitrate are dissolved in 1500 milliliters methanol at ambient temperature. The solution is filtered to remove a trace of residue. The solution is placed in a precipitating apparatus as shown in FIG. 1 and pumped to a mixing apparatus as depicted in FIG. 2. Butyl acetate is used as nonsolvent. The product is precipitated over a period of several minutes using a solution flow rate of 216 milliliters per minute and a nonsolvent flow rate of 1142 milliliters per minute. The mixing chamber gap is 0.030 inches. The precipitate is recovered and dried in a manner identical with Example I.

A fluffy white powder is recovered. The powder has a heat of reaction of 1826 calories per gram and a crystal density of 1.53 grams per cubic centimeter. A physical blend of the starting materials with identical stoichiometry has a heat of reaction of 1775 calories per gram and a calculated crystal density of 1.55 grams per cubic centimeter.

EXAMPLE IX

The powders from Examples V and VII are incorporated into sheathed cord as described in Example III. The deflagration rates as a function of material distribution in the cord is shown in Table I. The data illustrates the range of pyrotechnic burning rate performance that can be achieved by the subject compositions.

TABLE I

| COMPOSITION | CORE LOAD (GRAINS/FT) | LINEAR BURNING RATE (IN/SEC) |
|---|---|---|
| Example VI | 1.3 | 7,140 |
| | 6.1 | 8,400 |
| | 10.5 | 10,330 |
| | 13.3 | 11,130 |
| | 24.8 | 11,130 |
| Example VII | 1.7 | 10,600 |
| | 12.0 | 14,240 |
| | 19.6 | 11,540 |

EXAMPLE X

Figure 5:
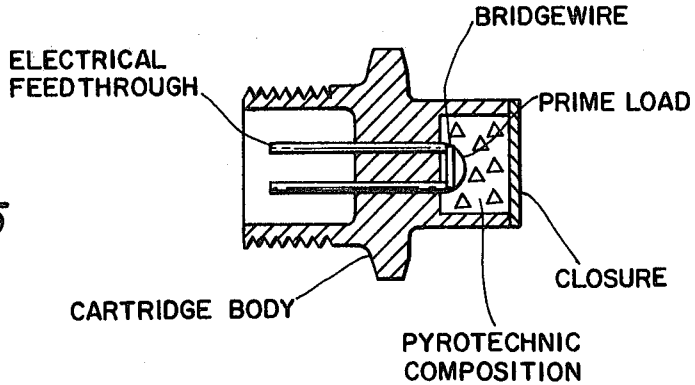
FIG. 5 is a schematic illustration of a cartridge testing setup for the products of the present invention.

The speed of ignition is determined by loading approximately 100 milligrams of the subject compositions into a closed pressure cartridge similar to that shown in FIG. 5, and firing the pressure cartridge in a 5cc closed bomb. The pressure in the bomb is measured by a fast response transducer and recorded as a function of time. The pressure cartridge consists of an exploding bridgewire mounted in a suitable cartridge case. The bridgewire is primed with 5mg of an initiating pyrotechnic powder. The subject composition is loaded into the cartridge over the priming load, and the cartridge closed with a crimped aluminum cap. The ignition time of the compositions is taken as the time between the application of current to the bridgewire to first detectable increase in the pressure. The burning time is taken as the time elapsed between the first detectable increase in the pressure to the peak pressure. Examples of the subject compositions tested in this manner are given in Table II.

The data demonstrates the very fast function times attainable in devices incorporating the subject compositions, which makes the compositions useful as gun ignitors and in pressure cartridges and squibs.

Comparable data for black powder of classification FFFG granular size, is shown in Table II for comparison purposes.

TABLE II

| Composition | Ignition Time (Milliseconds) | Burning Time (Milliseconds) | Peak Pressure Pounds Per Square Inch Gauge) |
|---|---|---|---|
| 25% $Cs_2B_{10}H_{10}$ coprecipitated with 75% $KNO_3$ | 0.75 | 0.75 | 712 |
| 15% $((CH_3)_4N)_2$ $B_{10}H_{10}$ coprecipitated with 85% $KNO_3$ | 1.2 | 0.8 | 1,100 |
| FFFG Black Powder | 1.2 | 4 | 600 |

The processes, and the resulting specific compositions, disclosed herein in which an exclusive property or privilege is claimed are to be defined, as follows

We claim:

1. A process for preparing a coprecipitated composition of a solid oxidizing agent and certain simple decahydrodecaborate salts, having the common anion $B_{10}H_{10}^{-2}$ wherein the cation is selected from the group consisting of:

A. ammonium, wherein the salt has the formula $(NH_4)_2\ B_{10}H_{10}$;

B. hydrazinium, wherein the salt has the formula $(NH_2NH_3)\ B_{10}H_{10}$;

C. substituted ammonium cations, wherein the salt has the general formula $(R_3NH)_2\ B_{10}H_{10}$, wherein further R is selected from the group consisting of hydrogen and alkyl radicals containing less than six carbon atoms;

D. substituted hydrazinium cations, wherein the salt has the general formula $(R_2NNR_2H)_2\ B_{10}H_{10}$ wherein further R is selected from the group consisting of hydrogen and alkyl radicals containing less than six carbon atoms, comprising the steps of:

i. dissolving both the decahydrodecaborate (−2) salt and the oxidizing agent in a mutually soluble solvent, at a temperature sufficiently high to maintain said salt and said oxidizing agent in solution;

ii. forming a pressurized stream of said solution and bringing said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

2. A process for preparing a coprecipitated composition of a solid oxidizing agent and certain simple decahydrodecaborate salts, having the common anion $B_{10}H_{10}^{-2}$, and the cation selected from the group consisting of:

A. tetramethylammonium, $(CH_3)_4N+$, tetraethylammonium, $(CH_3\ CH_2)_4N+$, and quaternary ammonium cations having the general formula $R_4N+$ where R is an alkyl radical;

B. pyrididinium, bipyridinium aryl-diazonium, aryl containing cations and substituted aryl containing cations, comprising the steps of:

i. dissolving both the decahydrodecaborate (−2) salt and the oxidizing agent in a mutually soluble solvent, at a temperature sufficiently high to maintain said salt and said oxidizing agent in solution;

ii. forming a pressurized stream of said solution and bringing said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

3. A process for preparing a coprecipitated composition of a solid oxidizing agent and a simple decahydrodecaborate salt, having the anion $B_{10}H_{10}^{-2}$, wherein the cation is guanidinium, and the salt has the formula $(C(NH_2)_3)_2 B_{10}H_{10}$, comprising the steps of:

i. dissolving both the decahydrodecaborate (−2) salt and the oxidizing agent in a mutually soluble solvent, at a temperature sufficiently high to maintain said salt and said oxidizing agent in solution;

ii. forming a pressurized stream of said solution and bringing said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

4. A process for preparing a coprecipitated composition of a solid oxidizing agent and a simple metallic decahydrodecaborate salt, having the common anion $B_{10}H_{10}^{-2}$, wherein the cation is selected from the group consisting of:

A. metal ions derived from the elements in Groups 1, 2, 8, 3b, 4b, 5b, 6b, 7b, and the elements of Groups 3a, 4a, 5a, and 6a which have atomic numbers respectively greater than 5, 14, 33 and 52, comprising the steps of:

i. dissolving both the decahydrodecaborate (−2) salt and the oxidizing agent in a mutually soluble solvent, at a temperature sufficiently high to maintain said salt and said oxidizing agent in solution;

ii. forming a pressurized stream of said solution and bringing said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

5. A process for preparing a coprecipitated composition of a solid oxidizing agent and a simple metallic decahydrodecaborate salt, having the common anion $B_{10}H_{10}^{-2}$, wherein the metallic salt is selected from the group consisting of cesium decahydrodecaborate, $Cs_2B_{10}H_{10}$, and potassium decahydrodecaborate, $K_2B_{10}H_{10}$, comprising the steps of:

i. dissolving both the decahydrodecaborate (−2) salt and the oxidizing agent in a mutually soluble solvent, at a temperature sufficiently high to maintain said salt and said oxidizing agent in solution;

ii. forming a pressurized stream of said solution and bringing said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

6. A process according to claim 1 wherein the simple decahydrodecaborate salt selected is bis-ammonium decahydrodecaborate, and said solid oxidizer is selected from the group consting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

7. The coprecipitation product of bis-ammonium decahydrodecaborate and a solid oxidizer, according to the process of claim 6.

8. A process according to claim 2 wherein the simple decahydrodecaborate salt selected is bis-tetamethylammonium decahydrodecaborate, and said solid oxidizer is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

9. The coprecipitation product of bis-tetramethylammonium decahydrodecaborate and a solid oxidizer, according to the process of claim 8.

10. A process according to claim 3 where said solid oxidizer is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

11. The coprecipitation product of bis-guanidinium decahydrodecaborate and a solid oxidizer, according to the process of claim 10.

12. A process according to claim 5 wherein the simple metallic decahydrodecaborate salt selected is cesium decahydrodecaborate and said solid oxidizer is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

13. The coprecipitation product of cesium decahydrodecaborate and a solid oxidizer, according to the process of claim 12.

14. A process according to claim 6 wherein said oxidizer is ammonium nitrate, said solvent is methanol and said nonsolvent stream is butyl acetate.

15. The coprecipitation product of bis-ammonium decahydrodecaborate and ammonium nitrate, according to the process of claim 14.

16. A process according to claim 8 wherein said oxidizer is potassium nitrate, said solvent is water and said nonsolvent stream is isopropanol.

17. The coprecipitation product of bis-tetramethylammonium decahydrodecaborate and potassium nitrate, according to the process of claim 16.

18. A process according to claim 10 wherein said oxidizer is guanidine nitrate, said solvent is methanol, and said nonsolvent stream is butyl acetate.

19. The coprecipitation product of bis-guanidinium decahydrodecaborate and guanidine nitrate, according to the process of claim 18.

20. A process according to claim 12 wherein said oxidizer is potassium nitrate, said solvent is water, and said nonsolvent stream is acetone.

21. The coprecipitation product of cesium decahydrodecaborate and potassium nitrate, according to the process of claim 20.

22. A process according to claim 1, wherein said step of washing with an inert and nonsolvent fluid comprises washing with butyl acetate.

23. A process according to claim 2, wherein said step of washing with an inert and nonsolvent fluid comprises washing with butyl acetate.

24. A process according to claim 3, wherein said step of washing with an inert and nonsolvent fluid comprises washing with butyl acetate.

25. A process according to claim 4, wherein said step of washing with an inert and nonsolvent fluid comprises washing with butyl acetate.

26. A process according to claim 5, wherein said step of washing with an inert and nonsolvent fluid comprises washing with butyl acetate.

* * * * *